US006662858B2

(12) United States Patent
Wang

(10) Patent No.: US 6,662,858 B2
(45) Date of Patent: Dec. 16, 2003

(54) COUNTER FLOW HEAT EXCHANGER WITH INTEGRATED FINS AND TUBES

(76) Inventor: Ching-Feng Wang, No. 13, Lane 138, Wanda Rd., Yangmei Jen, Taoyuan Hsien, Taiwan (CN)

( * ) Notice: Subject to any disclaimer, the term of this patent is extended or adjusted under 35 U.S.C. 154(b) by 0 days.

(21) Appl. No.: 10/173,641

(22) Filed: Jun. 19, 2002

(65) Prior Publication Data

US 2003/0168204 A1 Sep. 11, 2003

(30) Foreign Application Priority Data

Mar. 8, 2002 (TW) ..... 091104435

(51) Int. Cl.[7] ..... F28F 7/00

(52) U.S. Cl. ..... 165/80.3; 165/80.4; 165/104.33; 165/104.21; 361/699; 257/714; 174/15.1

(58) Field of Search ..... 165/166, 107.33, 165/185, 104.21, 80.4, 146, 170, 916; 361/698, 699; 257/714; 174/15.1

(56) References Cited

U.S. PATENT DOCUMENTS 4,712,612 A * 12/1987 Okamoto et al. ..... 165/146
5,036,911 A * 8/1991 So et al. ..... 165/170
5,832,989 A * 11/1998 Osakabe et al. ..... 165/104.33
6,005,772 A * 12/1999 Terao et al. ..... 361/699
6,220,340 B1 * 4/2001 Cheong et al. ..... 165/916
6,341,646 B1 * 1/2002 Tanaka et al. ..... 165/104.33
6,527,045 B1 * 3/2003 Osakabe et al. ..... 165/104.33

* cited by examiner

*Primary Examiner*—Terrell L Mckinnon
(74) *Attorney, Agent, or Firm*—Troxell Law Office PLLC

(57) ABSTRACT

A counter flow heat exchanger with integrated fins and tubes comprises metal plates overlapping with each other. Each of the metal plates has multiple elongated ridges spacing apart from each other. Adjacent metal plates oppositely overlap with each other such that the ridges in pairs form horizontal tubes and multiple connecting tubes on the plates form vertical tubes. A lowermost plate is set on two guide tubes, which are connected to lower ends of the connecting tubes and connected to a fluid pumping unit via a connecting pipe respectively. Thus, fluid inside the heat exchanger flows counter to external air and a better efficiency of heat exchange can be reached effectively.

18 Claims, 7 Drawing Sheets

COUNTER FLOW HEAT EXCHANGER WITH INTEGRATED FINS AND TUBES

BACKGROUND OF THE INVENTION

1. Field of the Invention

The present invention relates to a heat exchanger, particularly to a heat exchanger having a novel design of fins and tubes.

2. Description of Related Art

A conventional plate type heat exchanger comprises a plurality of fins linked with tubes. The tubes are connected to a fluid pumping unit, e.g., a attach block, a compressor or a pump. In case of the attach block being associated with a heat source, fluid inside the tubes absorb heat generated by the heat source via the attach block and the heat can be dissipated by the fins. After this, the fluid again receives heat to perform another cycle of heat exchange repeatedly. Conventional fins are made with equipment entirely different from that for making the tubes so that it results in high expenses for the equipments and molding tools. Assembling various shapes and sizes of fins with the tubes is not readily done and working hours for the assembly job are higher so that manufacturing cost increase relatively. Conventionally, fins and tubes are joined by way of pressing or brazing. But, the pressed joints may result in high thermal resistance with low efficiency of heat transfer and the brazed joints may become crystallized to result in lower efficiency of heat transfer. Furthermore, the conventional plate type heat exchanger provides a fan to blow fresh air towards the fins and the tubes for accelerating heat dissipation. Ordinarily, air flow outside the tubes and fluid flow inside the tubes run across each other forming cross flows so that it occurs a phenomenon of temperature gradient between hot fluid at cross section of the inlet and the cool fluid at cross section of the outlet in the heat exchanger. Therefore, the tube has to be coiled multiply to ensure uniform temperature distributions. This, however, causes increased pressure loss within the system and thus reduced the efficiency of heat exchange, while the phenomenon of temperature gradient is still not completely eliminated. Therefore, when the heat exchanger is used in conjunction with an air conditioning system, the refrigerant flowing inside the tubes and air blown outside lead to the cool air out of the discharge port thereof with a non-uniform temperature distribution and it will result in a problem of unsatisfactory temperature sensitivity.

SUMMARY OF THE INVENTION

It is the main object of the present invention to provide a heat exchanger with integrated fins and tubes, which can eliminate thermal contact resistance occurring at the conventional joining points of the fins and tubes and enhance the efficiency of thermal conductivity.

Another object of the present invention is to provide a heat exchanger having integrated fins and tubes, with which working hours and equipment expense are reduced and it is possible to adapt to size changes of products for lowering the manufacturing cost.

A further object of the present invention is to provide a heat exchanger in which internal fluid and external air are arranged to counter flow to each other so that the efficiency of heat exchange can be enhanced and the phenomenon of temperature gradient can be eliminated to enhance the sensitivity of comfortable temperature.

BRIEF DESCRIPTION OF THE DRAWINGS

The present invention can be more fully understood by reference to the following description and accompanying drawings, in which.

DETAILED DESCRIPTION OF THE PREFERRED EMBODIMENTS

Figure 1:
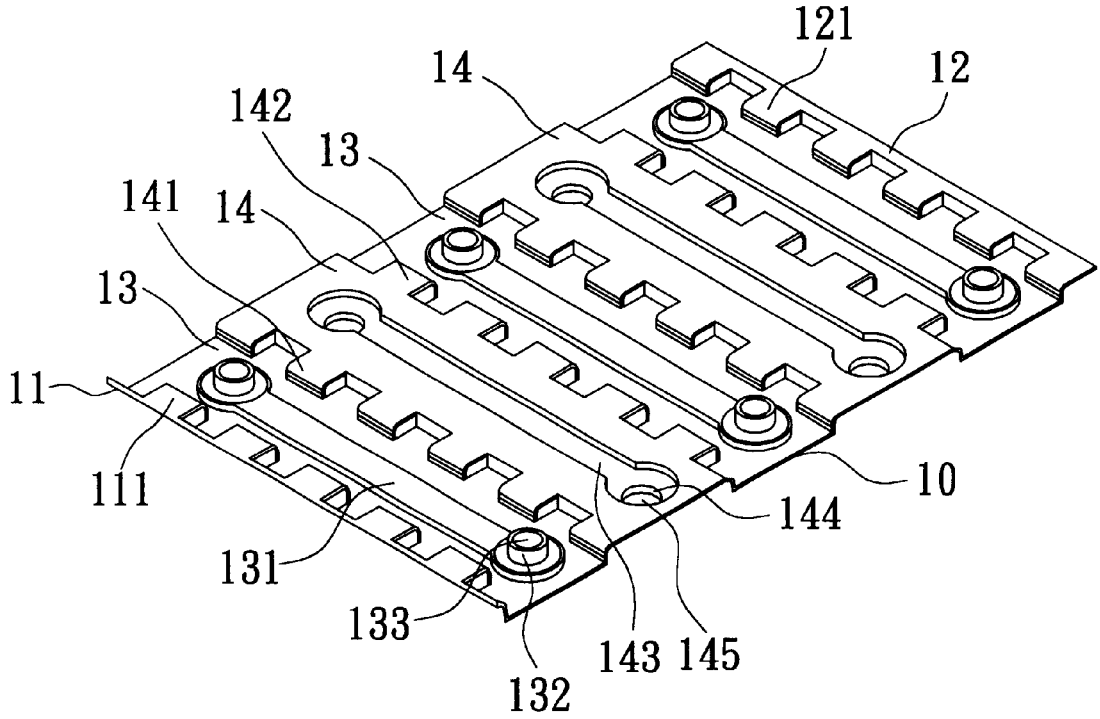
FIG. 1 is a perspective view of a base plate of the present invention in the first embodiment thereof.

Referring to FIG. 1, a counter flow heat exchanger with integrated fins and tubes according to the present invention comprises a metal base plate 10 worked and formed by a press or rolled by a cutter. The base plate 10 has two ends with a first projection 11 and a second projection 12, respectively, and a part in between having a plurality of depressions 13 with bottom surfaces and projections 14 with top surfaces. The first and second projections 11, 12 have regularly arranged inward extending projecting sections 111, 121, and the projections 14 each have regularly arranged projecting sections 141, 142 extending to opposite sides. A ridge 131 is placed in each depression 13 with both ends thereof having connecting tubes 132 reaching up to the level of the top surfaces of the projections 14. Similarly, a groove 143 is placed in each projection 14 with both ends thereof having connecting tubes 144 reaching down to the level of the bottom surfaces of the depressions 13. The connecting tubes 132 have through holes 133 at upper ends thereof and the connecting tubes 144 have through holes 145 at lower ends thereof. Further, the ridges 131 and the grooves 143 have shapes thereof corresponding to each other.

Figure 2:
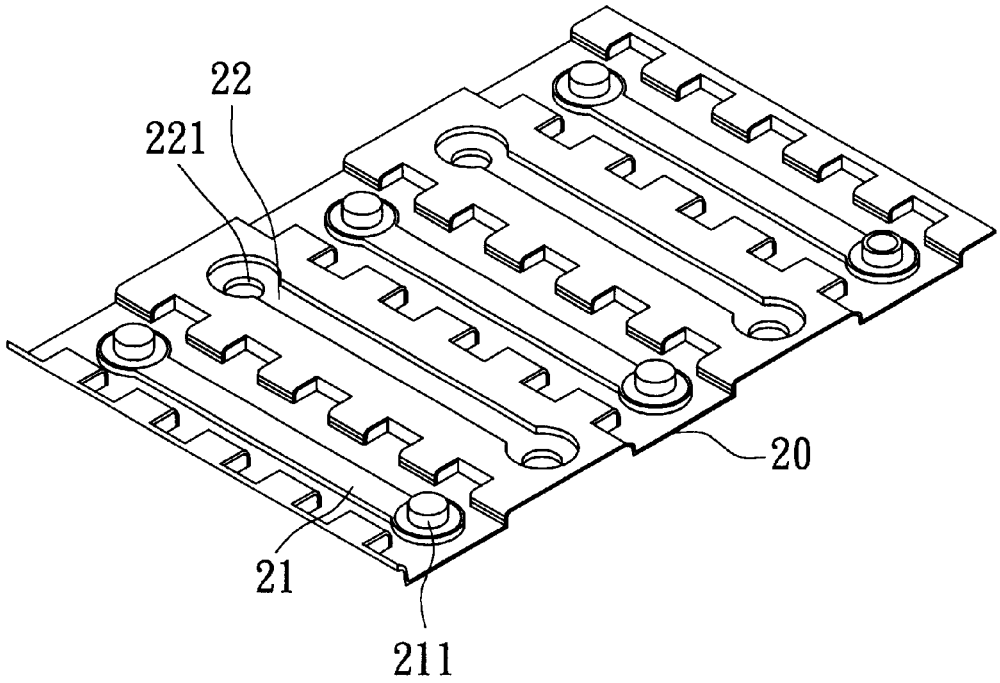
FIG. 2 is a perspective view of an external plate of the present invention in the first embodiment thereof.

Referring to FIG. 2 in company with FIG. 1, a metal external plate 20 is used for closing the through holes 133 and the grooves 143 in the base plate 10 from above. The external plate 20 is shaped like the base plates 10, having, however, connecting tubes 211 and 221 without through holes.

Figure 3:
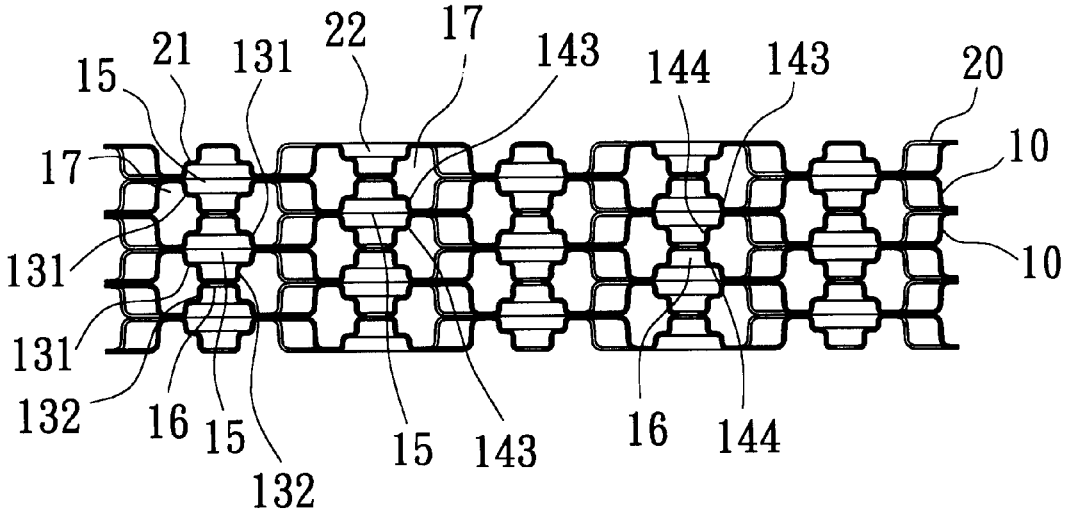
FIG. 3 is a sectional view illustrating the plates shown in FIGS. 1 and 2 being assembled.

Referring to FIG. 3, an external plate 20 and multiple base plates 10 are disposed to be reversed to each other and the plates are joined to each other by brazing. When assembled, pairs of ridges 21, 131, a respective space between two ridges 131 and a respective space between two grooves 143 form horizontal tubes 15. Ridge 21, 131 and connecting tubes 132 form series vertical tubes 16 and grooves 143 and connecting tubes 144 form series vertical tubes 16. Air holes 17 are provided between every neighboring two horizontal tubes 15 and formed by spaces between the projections 14 and the ridges 131 and between the depressions 13 and the grooves 143. Due to design of projecting sections 111, 121, 141, 142, it is possible to enhance turbulent effect while the air passes through the air holes 17 and to increase contact surface between air and the base plates 10. Hence, the efficiency of heat exchange can be promoted.

Figure 4:
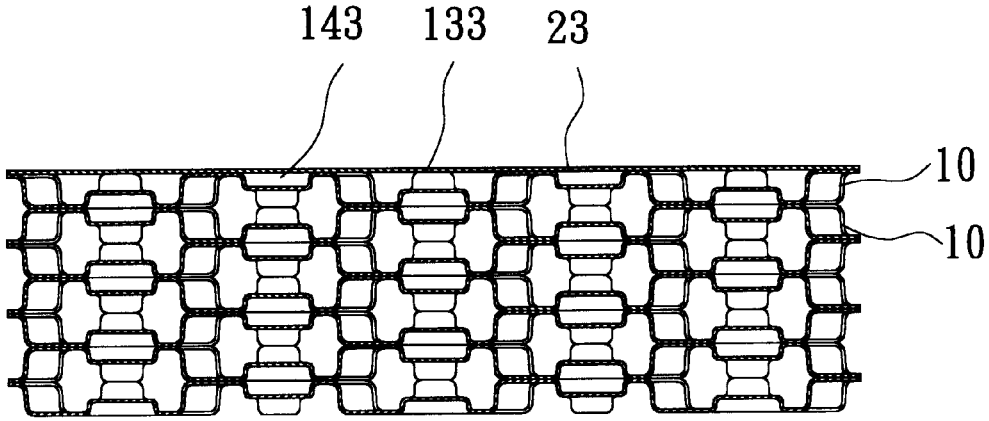
FIG. 4 is a sectional view illustrating the base plate shown in FIG. 1 being joined to a flat plate.

Referring to FIG. 4, alternatively, a flat plate 23 replaces the external plate 20 in FIG. 3 to close the through holes 133 and the depressions 143 so that the same heat exchange effect as that shown in FIG. 3 is attained.

Figure 5:
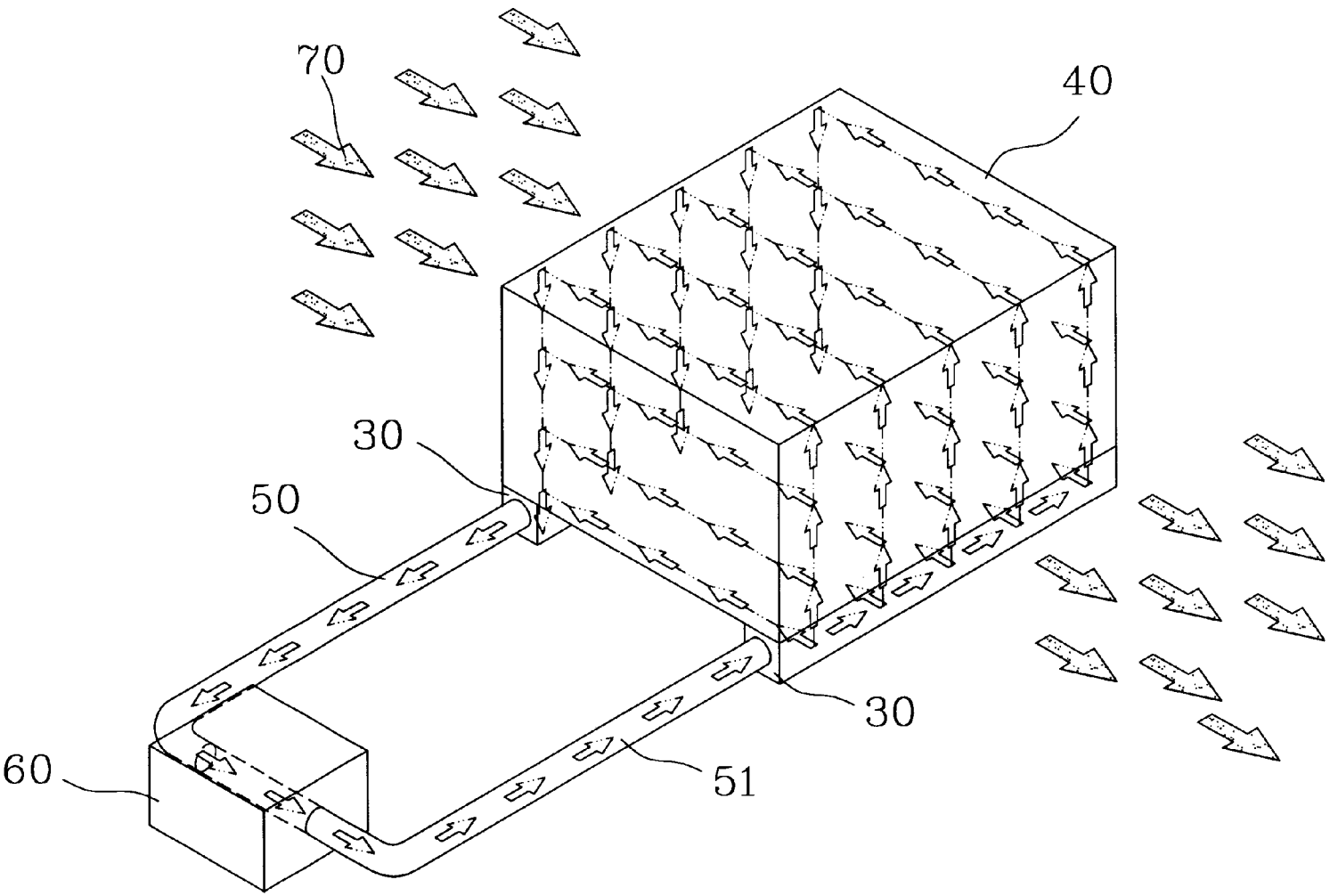
FIG. 5 is a perspective view illustrating the present invention being in a state of running.

For using the present invention, as shown in FIG. 5, a lowermost base plate of the plate assembly in FIG. 3 or FIG. 4 is connected to two guide tubes 30 so that a heat exchange unit 40 can be set up. The lowermost base plate at the through holes in the ridges thereof and in connecting tubes on grooves thereof communicate with the two guide tubes 30 respectively. The two guide tubes 30 are respectively connected to a fluid pumping unit 60 via connecting pipes 50, 51. If the fluid pumping unit 60 is an attach block over a heat source, heat generated by the heat source can be absorbed by the attach block and the absorbed heat is transmitted to the heat exchange unit 40 by the fluid in the tubes so that a process of heat dissipation can be conducted there. Due to the tubes of the heat exchange unit 40 being specially designed, the fluid in the tubes flows from right to left and outside fluid 70 counter flows from left to right respectively as directions shown in FIG. 5. The air holes 17 inside the heat exchange unit 40 shown in FIG. 3 ensure exchange of heat. Since there is a counter flow of internal fluid against external fluid, a better efficiency of heat exchange is achieved, and the deficiency of temperature gradient can be improved so that the fluid 70 has a uniform temperature distribution. If, for instance, the fluid pumping unit 60 is a compressor, the fluid in inside the tubes is refrigerant and the fluid 70 outside the tubes is air, the air out of the heat exchange unit 40 can be in a state of uniform temperature distribution so as to obtain a preferable temperature sensitivity.

Figure 6:
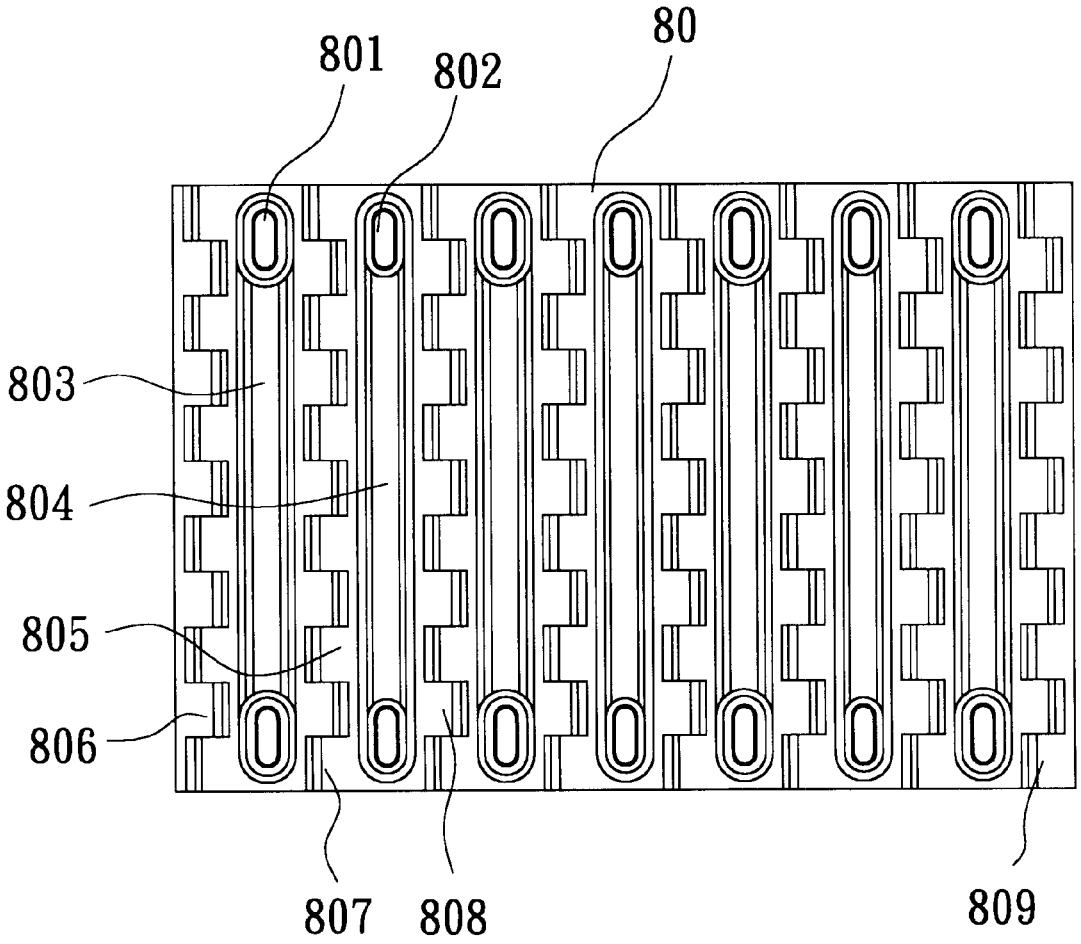
FIG. 6 is a top view of a base plate of the present invention in the second embodiment thereof.

Referring to FIG. 6 in company with FIG. 1 again, a second embodiment of the present invention has base plates 80 with oval shaped connecting tubes 801, 802 replacing the circular connecting tubes 132, 144 of the first embodiment. Thus, the oval cross section has a larger area than the circular cross section so that connecting tubes on two base plates 80 at adjacent levels can be connected to each other more conveniently and firmly.

Figure 7:
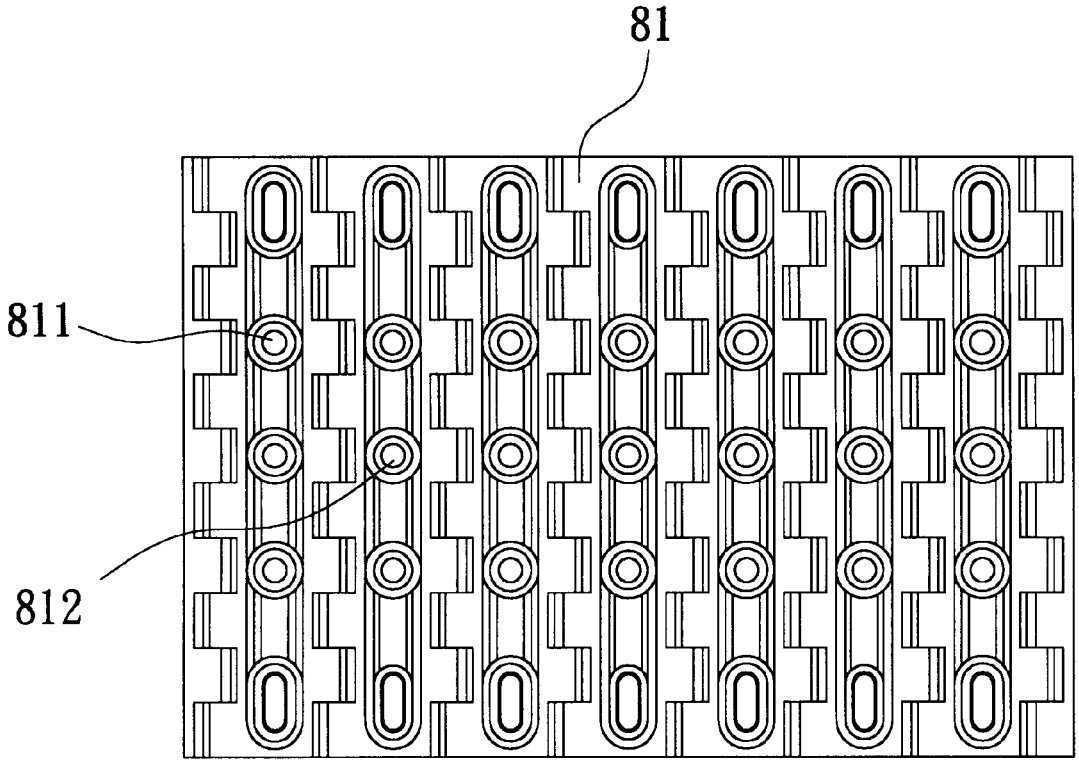
FIG. 7 is a top view of a base plate of the present invention in the third embodiment thereof.

As shown in FIG. 7 in company with FIG. 6, a third embodiment of the present invention has base plates 81. Each of the base plates 81 provides with additional circular connecting tubes 811 with or without through holes on each ridge thereof instead of the ridge 803 on the base plates 80 shown in FIG. 6. Furthermore, each groove on the base plate 81 has additional circular connecting tubes 812 with or without through holes instead of the groove 804 shown in FIG. 6. The connecting tubes 811, 812 can make two base plates 81 at adjacent levels be connected to each other more conveniently and firmly.

Figure 8:
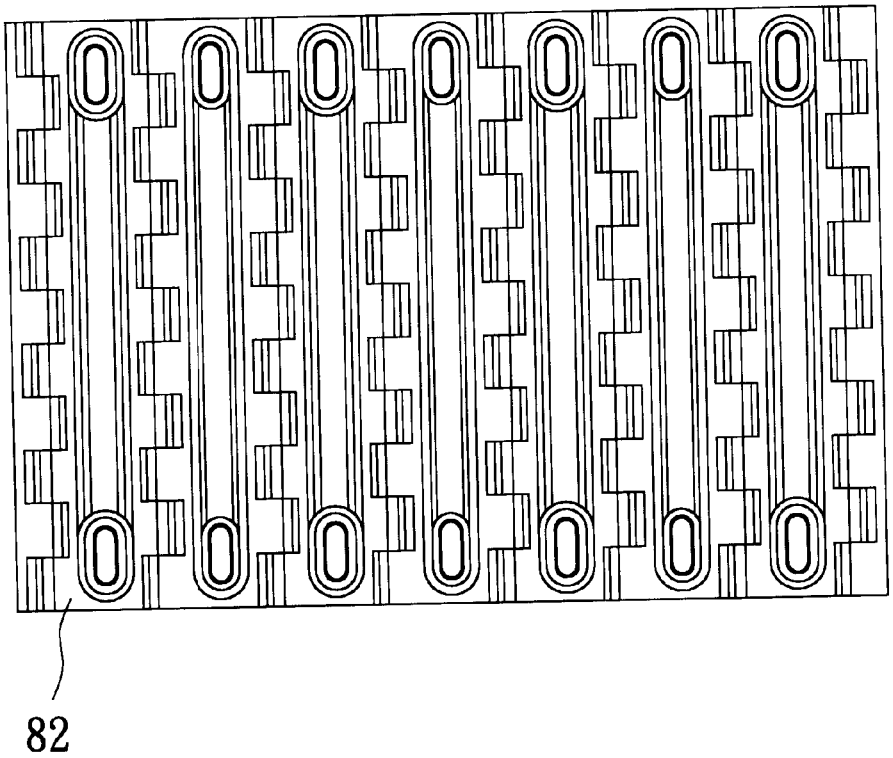
FIG. 8 is a top view of one of a base plate of the present invention in the fourth embodiment thereof.
Figure 9:
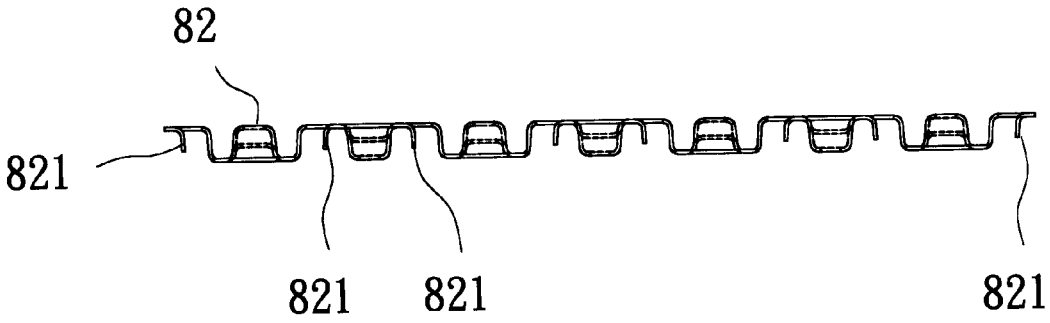
FIG. 9 is a side view of the base plate shown in FIG. 8.

Referring to FIGS. 8 and 9 in company with FIG. 6 again, a fourth embodiment of the present invention has base plates 82 and each of the base plates 82 is provided with reinforcing ribs 821 under each of the projecting sections.

Figure 10:
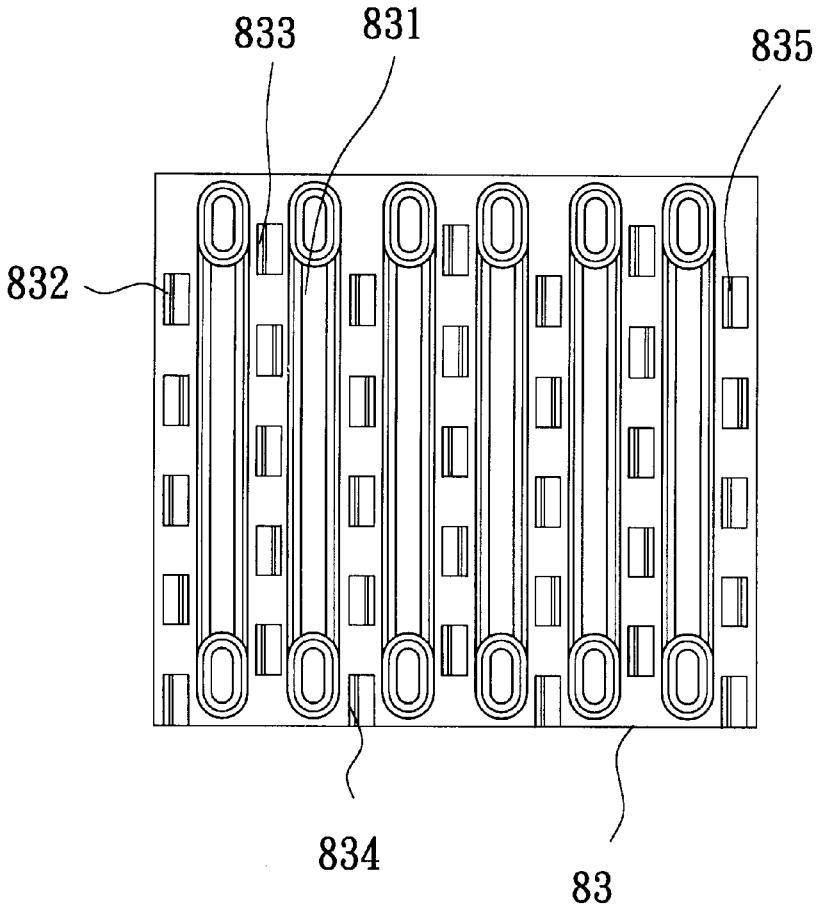
FIG. 10 is a top view of a base plate of the present invention in the fifth embodiment thereof.
Figure 11:
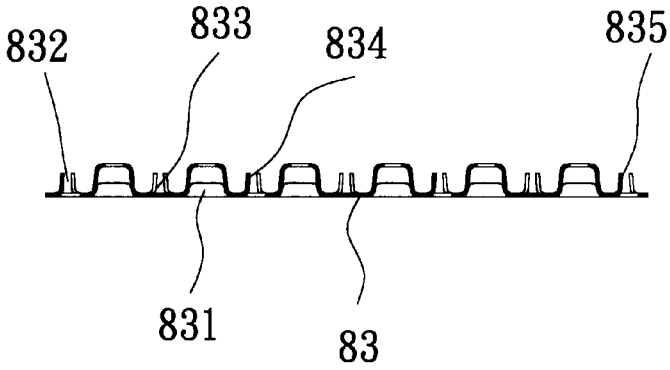
FIG. 11 is a sectional view of the base plate shown in FIG. 10.

As shown in FIGS. 10 and 11 in company with FIG. 6 again, a fifth embodiment of the present invention has base plates 83 and each of the base plates 83 is provided with ridges 831 instead of grooves 804 shown in FIG. 6. Projecting sections 806, 807, 808, 809 thereof are replaced with reinforcing ribs 832, 333, 834, 835, respectively.

Referring again to FIGS. 1, 2, 3 and 4, the fins and the tubes in the heat exchange unit are formed by way of the base plates 10 being associated with the external plate 20 integrally so that it can eliminate the efficiency loss of heat transfer due to thermal resistance at contact surfaces completely. Moreover, automatic working equipment can be utilized to perform the assembling job so that the equipment expense and labor cost can be lowered down largely. A consistent specification for the base plate 10 and the external plate 20 can be designated so that it is only needed to develop a single molding tool with a set of required width for the plates. The length of the plates can be formed by way of a continuous working process, e.g., each of the plates will be cut to a preset length thereof automatically during the working process so that all plates with different length thereof can be obtained as needed. In addition, the height of the exchanger unit can be adjusted by way of increasing the number of packed plates. Hence, heat exchange units with various lengths and heights are possibly made with the molding tool so that it is not necessary to prepare different molding tools for different specifications of heat exchanger units done in the conventional heat exchangers. Accordingly, the manufacturing cost can be saved greatly.

While the invention has been described with reference to preferred embodiments thereof, it is to be understood that modifications or variations may be easily made without departing from the spirit of this invention which is defined by the appended claims.

What is claimed is:

1. A heat exchanger, comprising:

a metal external plate; and at least one metal base plate, said at least one metal base plate and said external being piled up, having at least one elongated ridge with two ends, and a projecting connecting tube being located at said two ends respectively with an upper end thereof having through holes;

wherein every two neighboring base plates are disposed to be revered to each other, with said ridges thereof forming horizontal tubes and said connecting tubes and said grooves thereof connecting with each other in series to form vertical tubes, and said external plate is placed on an uppermost base plate to close said through holes;

wherein each of said base plates has at least one depression with a bottom surface and at least one projection with a top surface, said at least one ridge being placed in said at least one depression and said connecting tube at said ends of said at least one ridge and said top surface of said at least one projection having equal heights, said at least one projection has a groove and two ends of the groove has a connecting tube with through holes, and said connecting tubes of said groove and said bottom surface of said at least one depression having equal heights.

2. A heat exchanger according to claim 1, wherein a plurality of reinforcing ribs are disposed to spacing apart from each other at two sides of each of said ridges.

3. A heat exchanger according to claim 1, wherein said external plate is a flat plate.

4. A heat exchanger according to claim 1, wherein each of said projections on opposite sides extends a plurality of projecting sections spacing apart from each other and each of said base plates at two ends thereof has a first projection and a second projection respectively.

5. A heat exchanger according to claim 1, wherein said connecting tubes have an oval shaped cross-sections respectively.

6. A heat exchanger according to claim 1, wherein a lowermost base plate set on two guide tubes which are connected to said vertical tubes and connected to a fluid pumping unit via a connecting pipe respectively.

7. A heat exchanger according to claim 4, wherein said first and second projections have a plurality of inward extending projecting sections spacing apart from each other.

8. A heat exchanger according to claim 5, wherein each of said ridges provides at least one connecting tube between said two ends thereof and each of said grooves provides at least one connecting tube between said two ends thereof.

9. A heat exchanger according to claim 6, wherein said fluid pumping unit is an attach block.

10. A heat exchanger according to claim 7, wherein said projecting sections having downward extending reinforcing ribs.

11. A metal base plate for a heat exchanger, comprising at least one ridge with two ends, wherein two projecting connecting tubes are disposed on the ridge with each of the connecting tubes having an upper end with a through hole, wherein at least one depression with a bottom surface and at least one projection with a top surface are disposed next to each other, said at least one ridge is placed in said at least one depression and said connecting tubes are disposed at said two ends of said at least one ridge with a height being equal to a height of said top surface on said at least one projection, and said projection has an elongated groove with two ends thereof having a connecting tube with a through hole respectively having a height equal to said bottom surface of said at least one depression.

12. A metal base plate for a heat exchanger according to claim 11, wherein a plurality of reinforcing ribs are placed on two sides of each of said ridges.

13. A metal base plate for a heat exchanger according to claim 11, wherein said projection at two opposite sides thereof extends a plurality of projecting sections spacing apart from each other, and said base plates at two ends thereof has a first projection and a second projection, respectively, said first and second projections having inward extending projecting sections spacing apart from each other.

14. A metal base plate for a heat exchanger according to claim 11, wherein each of said connecting tubes is provided with an oval shaped cross section.

15. A metal base plate for a heat exchanger according to claim 13, wherein said projecting sections have downward extending reinforcing ribs.

16. A metal base plate for a heat exchanger according to claim 14, wherein each of said ridges provides at least one connecting tube being placed between said ends thereof and each of said grooves provides at least one connecting tube being placed between said ends thereof.

17. A heat exchanger, comprising:

a metal external plate; and at least one metal base plate, said at least one metal base plate and said external being piled up, having at least one elongated ridge with two ends, and a projecting connecting tube being located at said two ends respectively with an upper end thereof having through holes;

wherein every two neighboring base plates are disposed to be revered to each other, with said ridges thereof forming horizontal tubes and said connecting tubes and said grooves thereof connecting with each other in series to form vertical tubes, and said external plate is placed on an uppermost base plate to close said through holes;

wherein said external plate and said base plates have equal shapes, with said external plate having connecting tubes without through holes.

18. A heat exchanger, comprising:

a metal external plate; and at least one metal base plate, said at least one metal base plate and said external being piled up, having at least one elongated ridge with two ends, and a projecting connecting tube being located at said two ends respectively with an upper end thereof having through holes;

wherein every two neighboring base plates are disposed to be revered to each other, with said ridges thereof forming horizontal tubes and said connecting tubes and said grooves thereof connecting with each other in series to form vertical tubes, and said external plate is placed on an uppermost base plate to close said through holes;

wherein a lowermost base plate is set on two guide tubes which are connected to said vertical tubes and connected to a fluid pumping unit via a connecting pipe respectively.

* * * * *